US007000679B2

(12) United States Patent
Takahashi et al.

(10) Patent No.: US 7,000,679 B2
(45) Date of Patent: Feb. 21, 2006

(54) CASTING, VERTICAL CASTING METHOD AND VERTICAL CASTING APPARATUS

(75) Inventors: Hajime Takahashi, Takai (JP); Hajime Amano, Tokai (JP); Soichiro Kumura, Tokai (JP)

(73) Assignee: Daido Tokushuko Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/639,180

(22) Filed: Aug. 12, 2003

(65) Prior Publication Data

US 2004/0045697 A1 Mar. 11, 2004

Related U.S. Application Data

(62) Division of application No. 10/155,040, filed on May 24, 2002, now abandoned.

(30) Foreign Application Priority Data

May 31, 2001 (JP) ..... 2001-165557
Jun. 1, 2001 (JP) ..... 2001-167345

(51) Int. Cl.
*B22D 27/06* (2006.01)

(52) U.S. Cl. ..... 164/508; 164/415; 164/514

(58) Field of Classification Search ..... 164/508, 164/514, 415, 469, 475, 495, 413
See application file for complete search history.

(56) References Cited

U.S. PATENT DOCUMENTS 3,773,104 A 11/1973 Kocks
3,814,166 A * 6/1974 Watts ..... 164/472
3,817,316 A 6/1974 Koch et al.
3,838,730 A 10/1974 Nagaoka et al.
4,134,441 A 1/1979 Ohmori et al.
4,471,831 A * 9/1984 Ray ..... 164/508
4,610,296 A * 9/1986 Hiratake et al. ..... 164/469
4,612,973 A * 9/1986 Whang ..... 164/508
4,660,617 A 4/1987 Tsutsumi et al.
4,702,303 A 10/1987 Monheim et al.
4,727,926 A 3/1988 Tsutsumi et al.
5,205,345 A 4/1993 McClellan et al.
5,645,121 A * 7/1997 Barnes ..... 164/475
6,408,930 B1 6/2002 von Wyl et al.
6,443,216 B1 * 9/2002 Lombard et al. ..... 164/335

FOREIGN PATENT DOCUMENTS

| | | |
|---|---|---|
| EP | 1 094 125 | 4/2001 |
| FR | 1 370 584 | 8/1964 |
| JP | 62-197250 | 8/1987 |
| JP | 11-240710 | 9/1999 |

* cited by examiner

*Primary Examiner*—Thomas G. Dunn
*Assistant Examiner*—Len Tran
(74) *Attorney, Agent, or Firm*—Koda & Androlia

(57) ABSTRACT

A molten steel of a special steel or the like including a high-alloy steel is poured in a mold whose bottom portion is closed with a dummy head of a lift table. As the lift table is vertically moved down at a given casting speed, a casting whose lower end is supported by the dummy head is continuously pulled out from the bottom portion of the mold. As a pair of movable molds that constitute the mold are relatively moved away from each other in synchronism with the downward movement of the lift table, both widthwise side surfaces of the casting are provided with required tapering.

1 Claim, 11 Drawing Sheets

CASTING, VERTICAL CASTING METHOD AND VERTICAL CASTING APPARATUS

FIELD OF THE INVENTION

The present invention relates to a casting of a predetermined length, which is acquired by vertically pulling out a casting that has been cooled down in a mold so as to have only its surface portion coagulated (or a shell formed on the surface), and a vertical casting method and a vertical casting apparatus which cast the casting.

DESCRIPTION OF THE RELATED ART

In the field of nonferrous metals, such as aluminum, a vertical casting method is known that casts a casting of a predetermined length by pouring molten steel in a mold, which is open to the top and bottom, supporting the lower end of a casting, which has been cooled down in the mold so as to have a shell formed on the surface, on a dummy head of a lift table provided below the mold in a movable manner and vertically pulling out the casting from the bottom portion of the mold by vertically moving the lift table downward at a given speed.

Because the vertical casting method is advantageous over the ingot-making method in various factors, such as energy saving, power dissipation, attempts have been made to cast particularly castings with large cross sections with general kinds of special steels including high-alloy steel and tool steel and ensure still standing coagulation of the castings. However, castings that are obtained from the steels by the vertical casting method suffer the occurrence of multiple internal defects, such as the center porosity and center segregation or V-shaped segregation, thus degrading the quality of the castings and lowering the yield. In addition, the conventional vertical casting method may have an internal defect of a casting head cavity occurring in a casting. In other words, the conventional vertical casting method could not produce castings that could sufficiently meet such a present strict demand on the quality of castings as required of special steels including high-alloy steel and tool steel.

SUMMARY OF THE INVENTION

The present invention has been proposed to solve the problem of the prior art, and aims at providing a casting which has fewer internal defects, such as the center porosity, casting head cavity and center segregation or V-shaped segregation, and has improved quality and yield, and a vertical casting method and a vertical casting apparatus which can cast such casting.

To solve the problem and achieve the above object preferably, according to one aspect of the invention, there is provided a casting of a predetermined length that is cast by pouring a molten special steel including a high-alloy steel and tool steel in a mold open to the top and bottom thereof and vertically pulling out a casting having a required cross-sectional shape and having a shell formed on a surface from a bottom portion of the mold, and characterized in that at least a pair of opposing sides being tapered in such a way that an opposite side size of both sides becomes smaller toward a bottom portion from a top portion.

To solve the problem and achieve the above object preferably, according to another aspect of the invention, there is provided a vertical casting method for casting a casting of a predetermined length by pouring a molten special steel including a high-alloy steel and tool steel in a mold open to the top and bottom thereof and vertically pulling out a casting having a required cross-sectional shape and having a shell formed on a surface from a bottom portion of the mold;

wherein at a time of casting the casting, tapering at least a pair of opposing sides of the casting in such a way that an opposite side size of both sides becomes smaller toward a bottom portion from a top portion by relatively moving at least a pair of opposing movable molds of the mold away from each other while pulling out the casting from the bottom portion of the mold.

To solve the problem and achieve the above object preferably, according to a different aspect of the invention, there is provided a vertical casting apparatus for casting a casting of a special steel including a high-alloy steel and tool steel, the apparatus comprising:

a mold which is open to the top and bottom thereof and has at least a pair of movable molds that are relatively moved close to or away from each other by movable means, and where a molten special steel including a high-alloy steel and tool steel is poured;

a lift table, provided below the mold in a vertically movable manner, for supporting a lower end of the casting having a shell formed on a surface thereof and pulling out the lower end of the casting from a bottom portion of the mold; and lifting means for moving the lifting table up and down.

To solve the problem and achieve the above object preferably, according to a different aspect of the invention, there is provided a vertical casting method for casting a casting of a predetermined length by pouring a molten special steel including a high-alloy steel and tool steel in a mold open to the top and bottom thereof and vertically pulling out the casting having a required cross-sectional shape and having a shell formed on a surface from a bottom portion of the mold;

wherein at a time of casting the casting, after completion of pouring, covering a top portion of the mold with a lid member and heating the molten steel in the mold with a plasma or arc with an internally defined heating chamber set in an atmosphere of an inert gas and under such a heating condition as to be able to keep a temperature of a surface of the molten steel at a solidus casting temperature or higher, thereby suppressing occurrence of an internal defect in the casting to be cast.

To solve the problem and achieve the above object preferably, according to a further aspect of the invention, there is provided a vertical casting apparatus for casting a casting of a predetermined length by pouring a molten special steel including a high-alloy steel and tool steel in a mold open to the top and bottom thereof, supporting a lower end of the casting having a shell formed on a surface thereof and pulling out the lower end of the casting from a bottom portion of the mold with a lift table, provided below the mold and movable up and down vertically by lifting means, characterized by comprising:

a lid member capable of covering a top portion of the mold and setting an internally defined heating chamber in an atmosphere of an inert gas; and heating means for heating the molten steel in the mold covered by the lid member with a plasma or arc.

DETAILED DESCRIPTION OF THE EMBODIMENTS

A description will be given below of castings according to the present invention, vertical casting methods and vertical casting apparatuses capable of casting said castings according to preferred embodiments of the present invention with reference to the accompanying drawings.

(First Embodiment)

Figure 1:
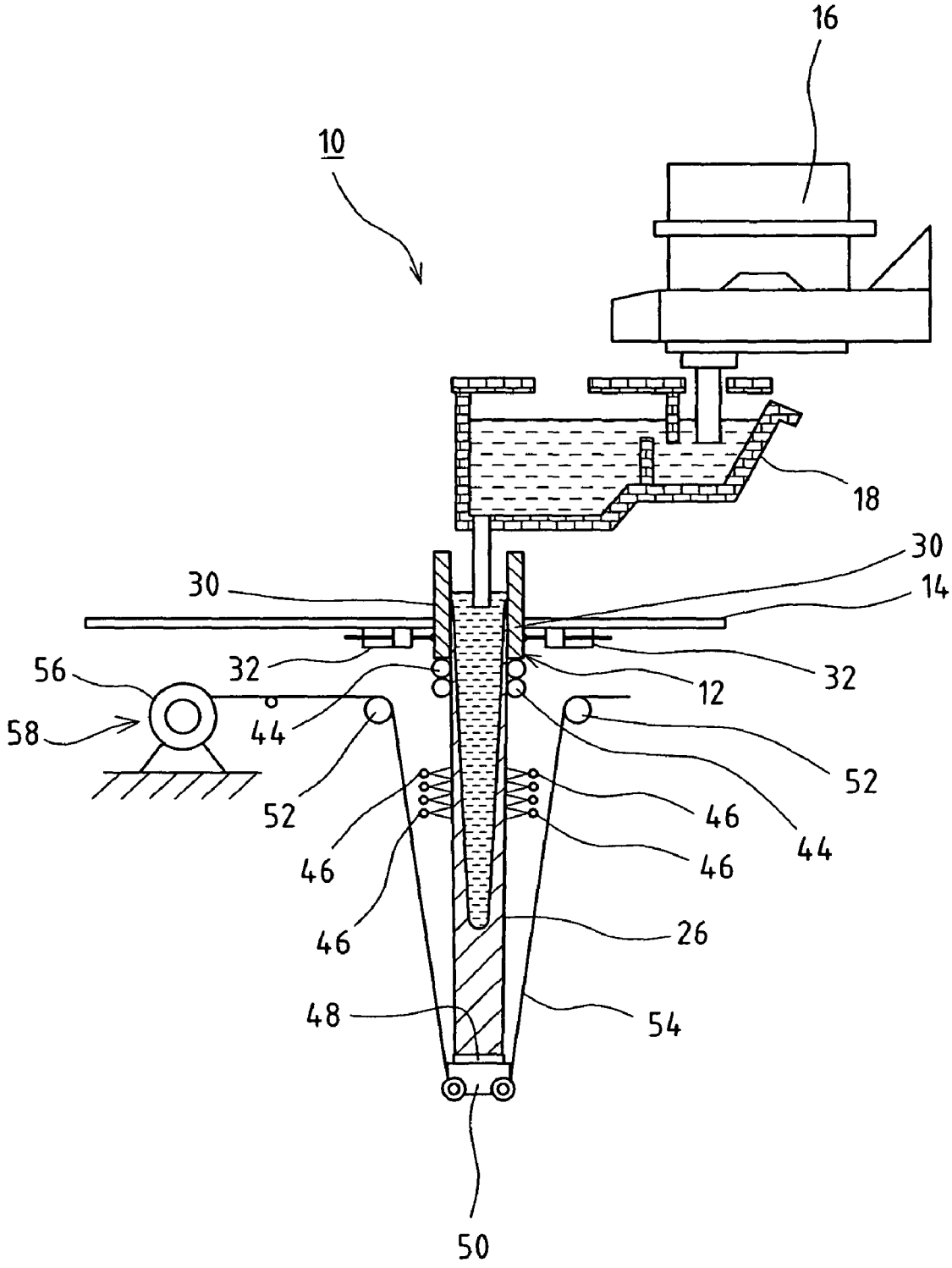
FIG. 1 is a schematic structural diagram illustrating a vertical casting apparatus according to a preferable first embodiment of the present invention.

FIG. 1 schematically illustrates a vertical casting apparatus 10 that executes a vertical casting method according to a first embodiment of the present invention. The vertical casting apparatus 10 has a mold 12 open to the top and bottom thereof placed on a casting bed 14. The vertical casting apparatus 10 is designed in such a way that molten steel of a special steel including a high-alloy steel and tool steel is poured in the mold 12 via a ladle 16 and a tundish 18 both provided above the mold 12. The mold 12 is designed in such a way as to be oscillated up and down by an unillustrated oscillation unit to reduce friction between a casting 26 to be pulled out from the bottom portion of the mold 12 and the mold 12, thereby preventing burning.

Figure 2:
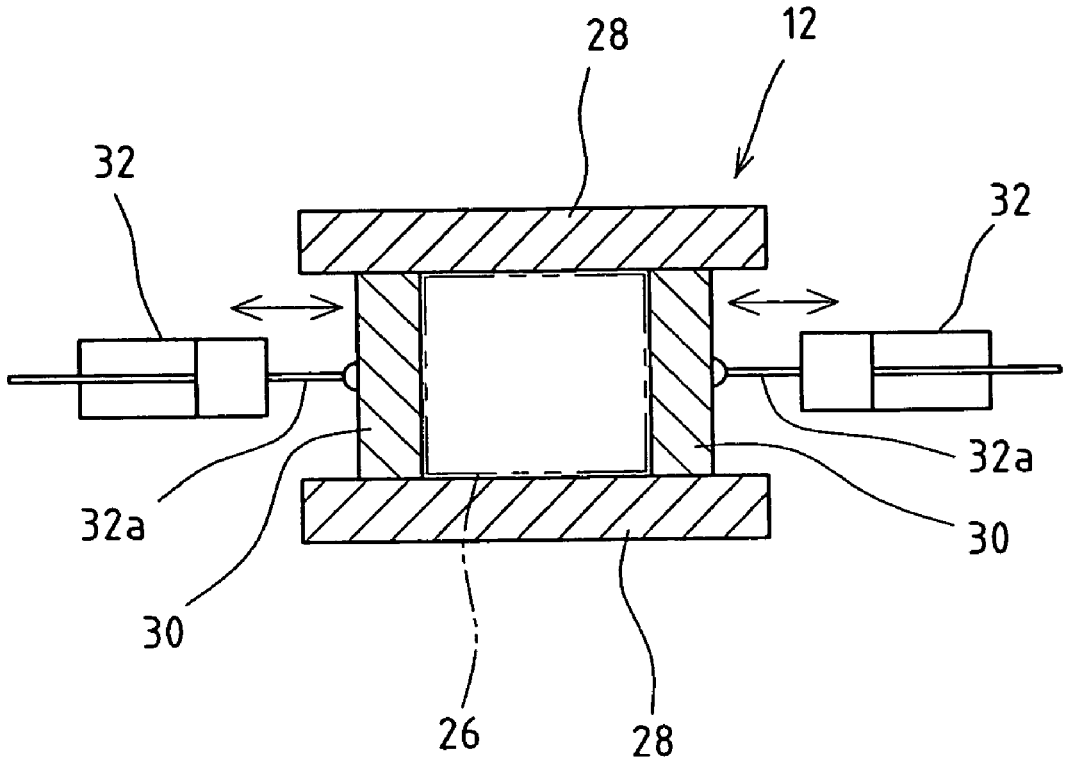
FIG. 2 is a schematic plan view showing a transverse section of the vertical casting apparatus according to the first embodiment.

As shown in FIG. 2, the mold 12 comprises a pair of fixed molds 28, 28 set apart in the thickness direction of the casting 26 and a pair of movable molds 30, 30 provided slidable between both fixed molds 28, 28 and set apart in the widthwise direction of the casting 26. Molten steel is poured in the space that is defined by those four molds 28, 28 and 30, 30. Each movable mold 30 is connected with a rod 32*a* of a hydraulic cylinder (moving means) 32 which is placed on the casting bed 14 and uses hydraulic pressure or the like. As both hydraulic cylinders 32, 32 are urged in the forward and backward directions synchronously, the pair of movable molds 30, 30 relatively move close to or away from each other. As the pair of movable molds 30, 30 are relatively moved away from each other while pulling out the casting 26 from the bottom portion of the mold 12 as will be described later, both widthwise sides (a pair of opposing sides) of the casting 26 pulled out from the mold 12 are tapered in such a way that the widthwise size of both sides (opposite side size) becomes smaller toward the bottom portion from the top portion (see FIG. 3). Actually, the casting 26 is tapered in a range of 4 to 15 mm per 1 m (see FIG. 4).

As shown in FIG. 1, a plurality of guide rolls 44, 44 that hold the casting 26, which has been cooled down (first cooling) in the mold 12 to have an outer shell (shell) formed on the surface, from both sides in the widthwise direction are arranged directly below the mold 12 in a freely rotatably manner. As the casting 26 immediately after being pulled out from the bottom portion of the mold 12 is held by the guide rolls 44, 44 from both sides, bulging is prevented. A plurality of nozzles 46 set apart in the up and down direction are provided below the laid-out locations of the guide rolls 44, 44 at both widthwise direction of holding the casting 26 in such a way as to face one another. As cooling water (water) is directly sprayed toward the casting 26 from each nozzle 46, secondary cooling is carried out to accelerate coagulation of the casting 26. It is to be noted that the guide rolls 44 and the nozzles 46 are designed in such a way as to be retractable to the positions where they do not interfere with a lift table 50 to be discussed later, so that the lift table 50 is allowed to move up and down between the guide rolls 44, 44 and the nozzles 46, 46 opposing in the widthwise direction.

The lift table 50, which has a dummy head 48 for supporting the lower end of the casting 26, is provided below the mold 12 in such a way as to be vertically movable. Pulleys 52, 52 are rotatably laid on both sides from which the casting 26 is held. A wire 54 whose one end is connected to an adequate fixed portion is put around both pulleys 52, 52, with its other end connected to a winch 56 whose speed is variable. The lift table 50 is suspended by the wire 54 stretched between both pulleys 52, 52 and is moved up and down by lifting means 58 that comprises the wire 54 and the winch 56. In other words, as the winch 56 is rotated in the direction of winding up the wire 54, the lift table 50 moves upward via the wire 54, and as the winch 56 is rotated in the direction of letting the wire 54 out, on the other hand, the lift table 50 moves downward via the wire 54. The lift-down speed (casting speed) of the lift table 50 in this case is set to a very low speed of 0.2 m/min or less to thereby suppress the occurrence of internal defects, such as the center porosity and center segregation or V-shaped segregation, in the cast casting 26.

(Operation of First Embodiment)

A description will now be given of the operation of the vertical casting method that is executed by the vertical casting apparatus according to the first embodiment. The winch 56 is rotated in a predetermined direction to move up the lift table 50. With the bottom portion of the mold 12 closed with the dummy head 48, molten steel of a special steel including a high-alloy steel and tool steel is poured in the mold 12 via the ladle 16 and the tundish 18. The molten steel poured in the mold 12 is subjected to first cooling in the mold 12, thus forming a shell on the surface of the molten steel. As the winch 56 is rotated in the reverse direction to vertically move down the lift table 50 at a given casting speed, the casting 26 whose bottom end is supported by the dummy head 48 is pulled out from the bottom portion of the mold 12.

The casting 26 immediately after being pulled out from the mold 12 is held by the guide rolls 44, 44 from both sides in the widthwise direction, as shown in FIG. 1, thus preventing the occurrence of bulging. As cooling water is sprayed on the casting 26 from the nozzles 46, 46 the secondary cooling of the casting 26 is carried out.

Figure 3:
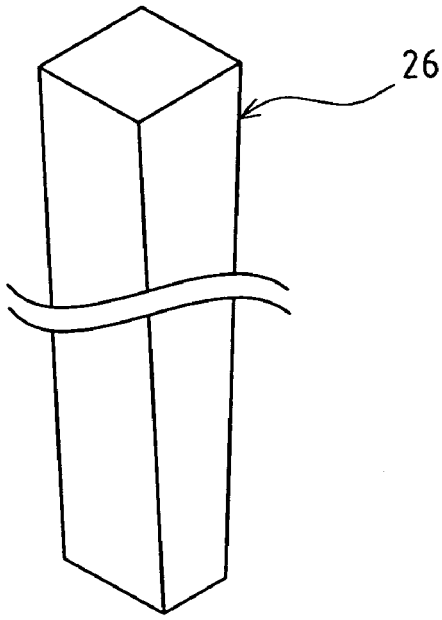
FIG. 3 is a schematic perspective view of a casting cast by the vertical casting apparatus according to the first embodiment.
Figure 4:
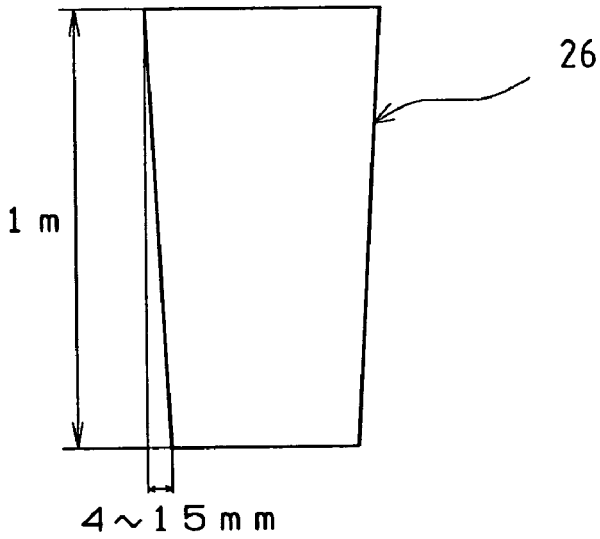
FIG. 4 is an explanatory diagram showing the size of tapering given to the casting according to the first embodiment.

In synchronism with the downward movement of the lift table 50, the pair of movable molds 30, 30 relatively move away from each other under the urging force of the hydraulic cylinders 32, 32, thereby giving both widthwise sides of the casting 26 with required tapering in such a way that the widthwise size of both sides becomes smaller toward the bottom portion from the top portion (see FIG. 3). Tapering the casting 26 this way suppresses the occurrence of internal defects, such as the center porosity and center segregation or V-shaped segregation, in the casting 26.

Figure 5A:
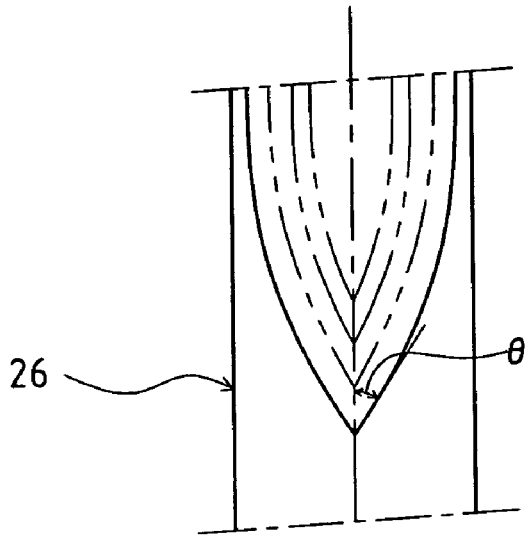
FIG. 5A PRIOR ART
FIG. 5 is an explanatory diagram showing coagulation front side angles of castings according to the prior art and the first embodiment.
Figure 5B:
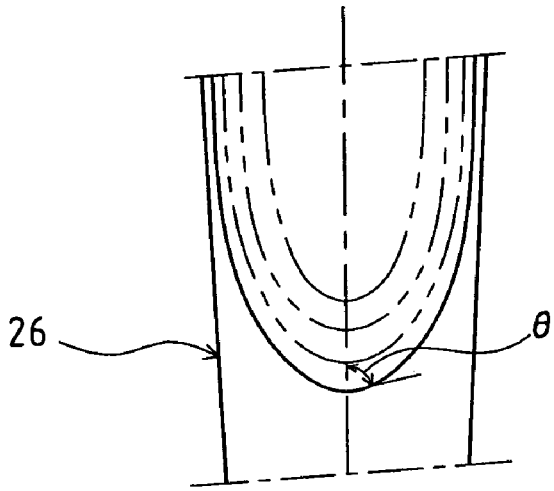

It seems that the occurrence of internal defects, such as the center porosity and center segregation or V-shaped segregation, is influenced by the angle of the coagulation front side of molten steel inside the casting. That is, in case where both widthwise sides of the casting 26 are straight, the angle (coagulation front side angle) θ with respect to the center line of the coagulation interface of the molten steel inside the casting is small as shown in FIG. 5A. This encourages the suction of the molten steel whose C, S, P or the like has become denser, causing multiple internal defects. In a case where both widthwise sides of the casting 26 or both sides in the thickness direction are tapered, on the other hand, the upper width becomes wider in the vicinity of the coagulation interface, making the angle θ larger, as shown in FIG. 5B. This reduces the suction of the molten steel whose C, S, P or the like has become denser, thus making it possible to adequately suppress the occurrence of the internal defects. The coagulation front side angle θ can be determined by observing the macro organization of the longitudinal cross section of the casting.

The widthwise size of both sides of the casting 26 that has been cast by the vertical casting apparatus 10 are tapered in such a way that the widthwise size becomes smaller toward the bottom portion (BOT portion) from the top portion (TOP portion) as shown in FIG. 3. This casting 26 has an excellent quality with fewer internal defects, such as the center porosity and center segregation or V-shaped segregation, inside. That is, the vertical casting method according to the first embodiment can sufficiently cope with steel types, such as special steels including high-alloy steel and tool steel, that require severe demands on the quality. In case of casting the casting 26 whose TOP portion has cross-sectional sizes of 500 mm or greater in thickness and 500 mm or greater in width, the vertical casting method according to the first embodiment is particularly effective.

Although the foregoing description of the first embodiment has been given of the case where a casting is tapered, a combination of the tapering scheme and the super slow casting speed may be employed as well. Setting the casting speed to 0.2 m/min or slower further increases the coagulation front side angle θ, reducing the suction of the molten steel whose C, S, P or the like has become denser. This further suppress the occurrence of internal defects, such as the center porosity and center segregation or V-shaped segregation, inside the cast casting 26.

With regard to the tapering of the casting, while only a pair of sides opposing in the widthwise direction of the casting are tapered in the first embodiment, only a pair of sides opposing in the thickness direction may be tapered or all of the four sides may be tapered. That is, at least one pair of opposing sides should be tapered.

Further, the moving means that moves the movable molds of the mold is not limited to hydraulic cylinders but may take the form of other various mechanisms, such as a ball screw, a screw and a rack and pinion, that are actuated by a motor. Although the unit that is a combination of a wire and a winch is mentioned as the lifting means for the lift table in the first embodiment, various other units, such as a hydraulic cylinder or a combination of a motor and a ball screw, can be used as well.

EXAMPLE 1

Figure 6:
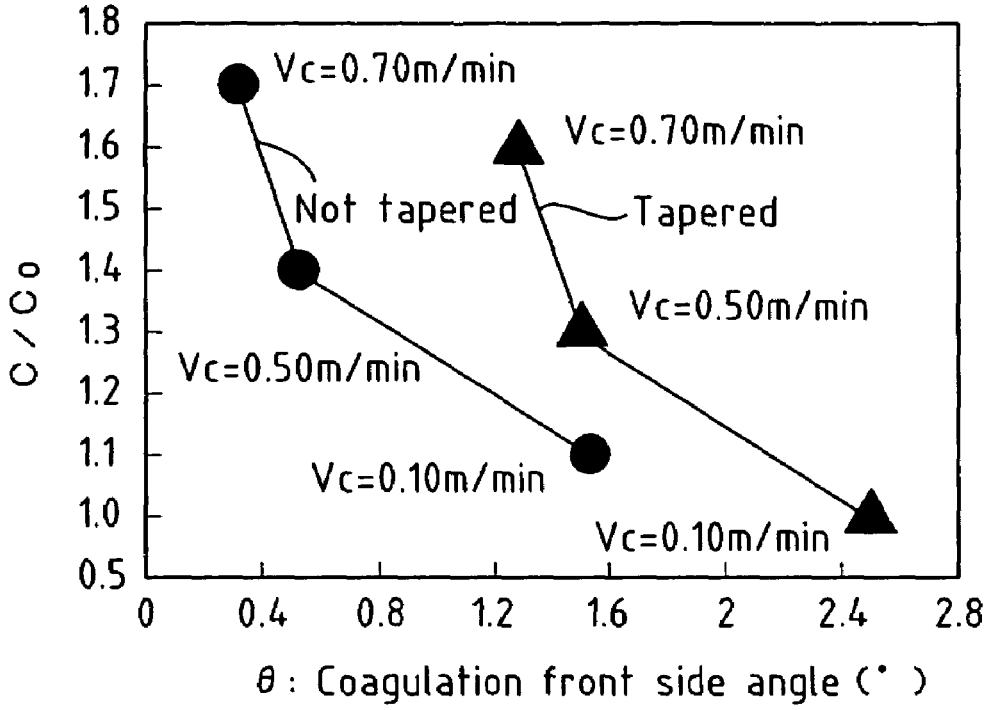
FIG. 6 is a graph showing the results of measuring the center segregation of C and the coagulation front side angle.

In case of casting a casting whose TOP portion has a thickness of 600 mm and a width of 750 mm using a special steel including a high-alloy steel and tool steel as a material, the results of measuring the center segregation of C and the coagulation front side angle θ for a case where no tapering is given and the casting speed (Vc) is variable (indicated by ●) and a case where tapering is given and the casting speed (Vc) is variable (indicated by ▲) are shown in FIG. 6. The casting was provided with a tapering of 4 mm/m.

As apparent from FIG. 6, it was confirmed that tapering a casting could suppress the segregation of C. It was also confirmed that even in case where no tapering was given, setting the casting speed slower could suppress the segregation of C in the center of the casting and could increase the coagulation front side angle θ. It was shown that tapering in addition to the lowering of the casting speed could further suppress the segregation of C in the center of the casting and could further increase the coagulation front side angle θ.

(Second Embodiment)

Figure 7:
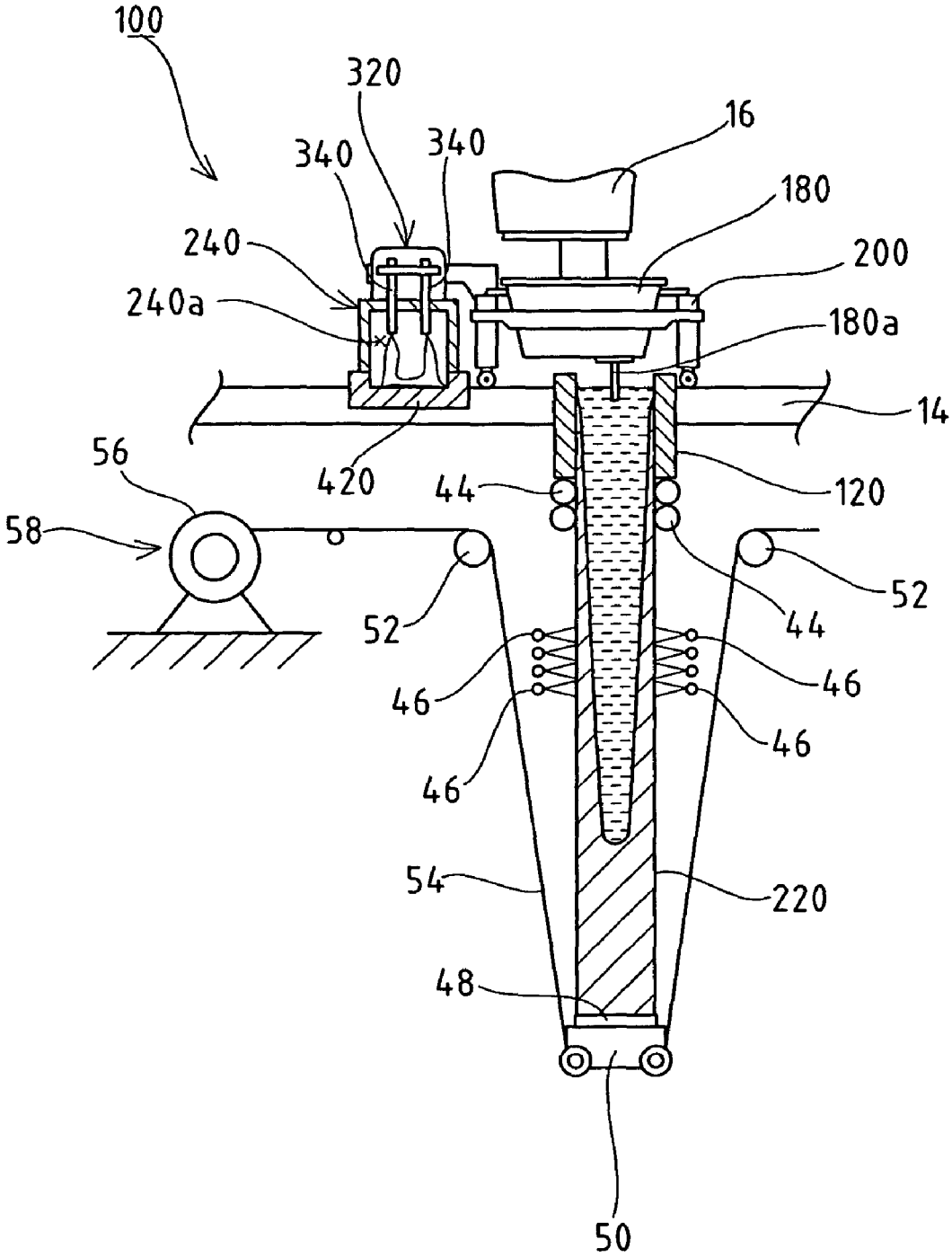
FIG. 7 is a schematic structural diagram illustrating a vertical casting apparatus according to a preferable second embodiment of the invention.

FIG. 7 schematically illustrates a vertical casting apparatus 100 that executes a vertical casting method according to a second embodiment of the present invention. Like or same reference numerals are given to those members of the vertical casting apparatus of the second embodiment which are the same as the corresponding members of the first embodiment to avoid repeating the detailed description. The vertical casting apparatus 100 has a mold 120 open to the top and bottom thereof placed on a casting bed 14. The vertical casting apparatus 100 is designed in such a way that molten steel of a special steel including a high-alloy steel and tool steel is poured in the mold 120 via a ladle 16 and a tundish 180 both provided above the mold 120. The tundish 180 is provided on a carriage 200 that is so constructed as to be movable along rails (not shown) laid on the casting bed 14, and is designed in such a way as to move between a casting position located above the mold 120 and a retracting position set away from the mold 120. The tundish 180 is provided in such a way as to be movable up and down with respect to the carriage 200 via an adequate lifting mechanism. At the time the tundish 180 moves between the casting position and the retracting position, a duck nozzle 180*a* provided on the tundish 180 is moved up to the position where it does not interfere with the mold 120. The mold 120 is designed in such a way as to be oscillated up and down by an unillustrated oscillation unit to reduce friction between a casting 220 to be pulled out from the bottom portion of the mold 120 and the mold 120, thereby preventing burning.

Figure 10A:
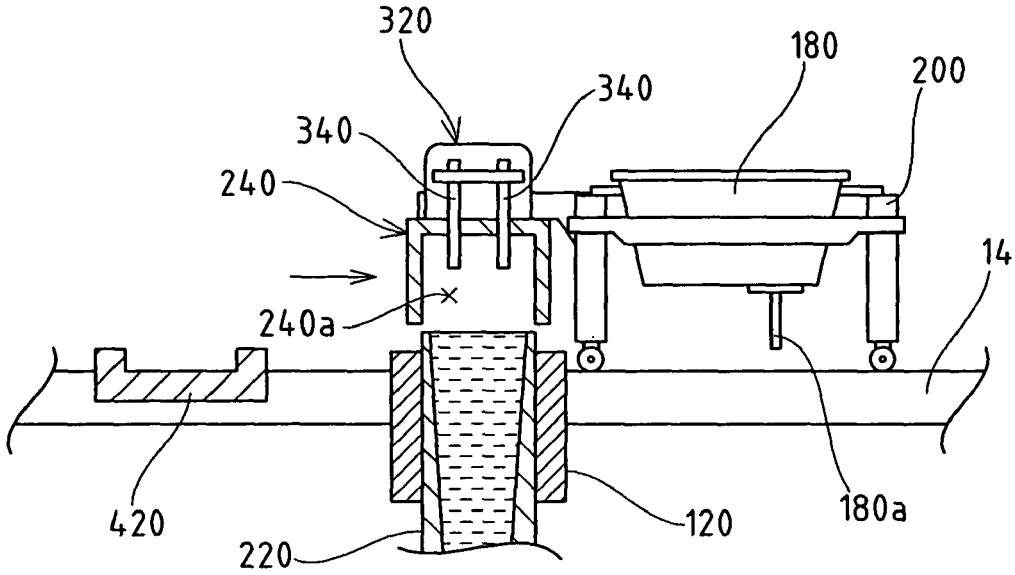
FIG. 10 is an explanatory diagram showing a heating step performed by the vertical casting apparatus according to the second embodiment.

The carriage 200 is provided with a lid member 240 which covers the top portion of the mold 120. The lid member 240 is designed in such a way as to come to a standby position (FIG. 7) set away from the mold 120 when the tundish 180 comes to the casting position and come to a heating position (FIG. 10) at which the top portion of the mold 120 is covered when the tundish 180 comes to the casting retracting position. The lid member 240 is provided in such a way as to be movable up and down with respect to the carriage 200 via an adequate lifting mechanism. At the time the lid member 240 moves between the standby position and the heating position, the lid member 240 is moved up to the position where it does not interfere with the mold 120 or the upper end portion (which will be discussed later) of the mold 120 that protrudes from the upper end of the mold 120.

Figure 8:
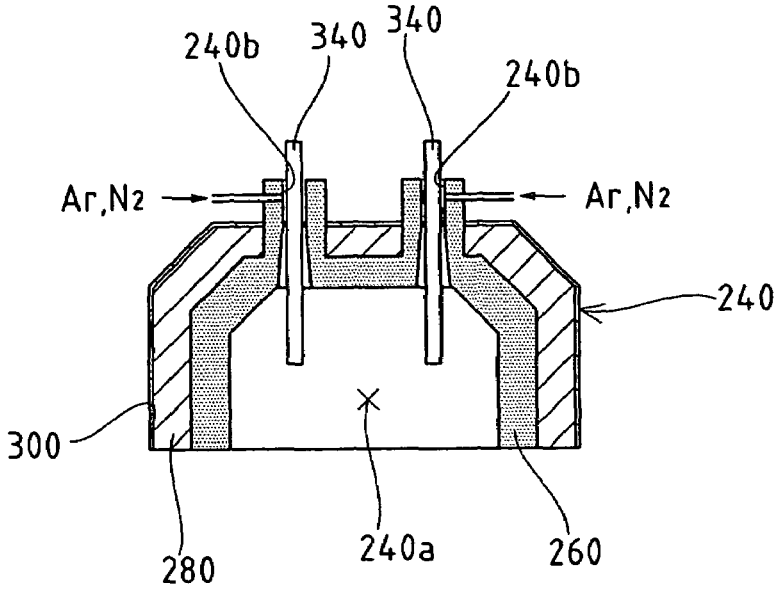
FIG. 8 is a schematic cross-sectional view of a lid member of the vertical casting apparatus according to the second embodiment.

As shown in FIG. 8, the lid member 240 is formed into a box with an open bottom and has a three-layer structure comprising an inside lining member 260 of a refractory material, an outside lining member 280 of a heat insulating material which covers the outer side of the inside lining member 260 and an iron shell 300 which covers the outer side of the outside lining member 280. A heating chamber 240*a* is defined inside the inside lining member 260. Plural holes (two in the second embodiment) 240*b* are formed in the top portion of the lid member 240. Electrodes 340 that constitute a heating unit (heating means) 320 which heats molten steel in the mold 120 located on the carriage 200 are inserted in a retractable manner into the heating chamber 240*a* through the holes 240*b*. After completion of pouring to be discussed later, in heating molten steel at the time of performing still standing coagulation, a predetermined voltage is applied between the casting 220 in the mold 120 and the electrodes 340 with the top portion of the mold 120 covered with the lid member 240, so that the molten steel in the mold 120 is heated by a plasma or arc discharged from the electrodes 340. At the time of heating the molten steel, an inert gas, such as Ar or $N_2$, is supplied into the heating chamber 240*a* via the holes 240*b* to set the interior of the chamber 240*a* in an atmosphere of the inert gas.

A refractory material which essentially consists of $Al_2O_3$ is preferably used for the inside lining member 260 and a heat insulating material which has $SiO_2$ doped into $Al_2O_3$ for an improved heat insulation is preferably used for the outside lining member 280. Those materials may however be replaced with other materials. The use of a heat insulating material having a low heat conductance for the outside lining member 280 can reduce the heat release of the lid member 240 at the time of heating and at the time of preheating which will be discussed later, thereby ensuring reduction of the applied power.

Figure 9:
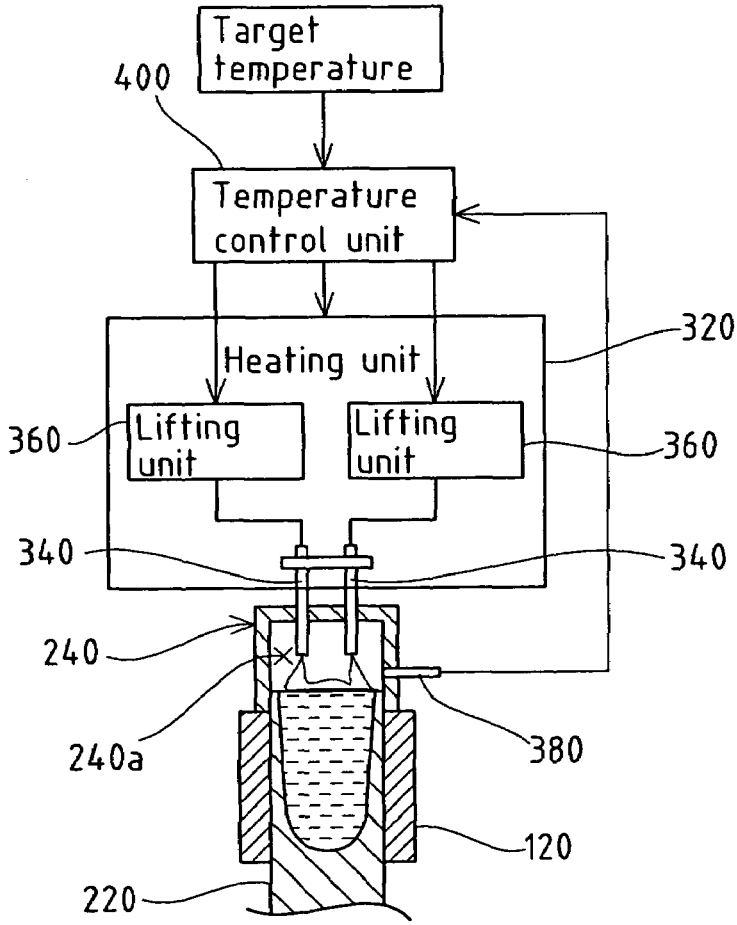
FIG. 9 is an explanatory diagram showing heating means of the vertical casting apparatus according to the second embodiment.

Each electrode 340 of the heating unit 320 is supported to be movable in the up and down direction by a lifting unit 360 equipped with an electric motor, a pulse generator or the like. The lid member 240 is provided with a temperature sensor 380 which detects the temperature of the heating chamber 240*a*, as shown in FIG. 9. The temperature detected by the temperature sensor 380 is input to a temperature control unit 400. The temperature control unit 400 is designed in such a way as to set the amount of power applied to the heating unit 320 based on the detected temperature and set the applied voltage and the supplied current based on the amount of power in order to hold the temperature of the heating chamber 240*a* at a preset target temperature. Based on the applied voltage, the temperature control unit 400 controls the operation of the lifting unit 360 to adjust the distance (gap) between the electrodes 340 and the surface level (meniscus) of the molten steel, thereby making the heating power variable. The variable heating power keeps the temperature of the heating chamber 240*a* at the target temperature. The target temperature of the heating chamber 240*a* is set to the level at which the surface level of the molten steel in the mold 120 covered by the lid member 240 can be held at or higher than the solidus casting temperature. This prevents the surface of the molten steel from being coagulated. That is, supplying the same amount of heat as the amount of heat released from the surface of the molten steel keeps the surface temperature at or higher than the solidus casting temperature.

Heating of the molten steel by the heating unit 320 is executed at the time of performing still standing coagulation after pouring is completed. At this time, upward movement of the lift table 50 pushes up the upper end portion of the casting 220 having a shell formed on the surface by a predetermined length from the upper end of the mold 120 (see FIG. 10A), thereby preventing electric corrosion or a stray current from occurring on or being supplied to the mold 120 by the plasma or arc that is discharged from the electrodes 340. While carbon, tungsten and copper are available as the material for the electrodes 340, other materials may be used as well.

As shown in FIG. 7, a power receiving plate 420 of, for example, carbon is arranged on the casting bed 14 under the lid member 240 that is at the standby position, and the lid member 240 is placed on the power receiving plate 420. With an inert gas fed to the heating chamber 240*a*, as a predetermined voltage is applied between the power receiving plate 420 and the electrodes 340, a plasma or arc is discharged from the electrodes 340. The plasma or arc can preheat the heating chamber 240*a* or the lid member 240 to a predetermined temperature. According to the second embodiment, the heating unit 320 that is used to heat molten steel also serves as the preheating means that preheats the lid member 240. Instead, independent separate means may be used or the heating system is not limited to the heating by a plasma or arc but a burner or the like can be used as well. While the most preferable preheating temperature for the lid member 240 is equal to or higher than the target temperature of the heating chamber 240*a*, the preheating temperature may be lower than the target temperature.

As shown in FIG. 1, the lift table 50 having the guide rolls 44, 44, the nozzles 46 and the dummy head 48 and the lifting means 58 are arranged below the mold 120 as per the first embodiment.

(Operation of Second Embodiment)

A description will now be given of the operation of the vertical casting method that is executed by the vertical casting apparatus according to the second embodiment. The winch 56 is rotated in a predetermined direction to move up the lift table 50. With the bottom portion of the mold 120 closed with the dummy head 48, molten steel of a special steel including a high-alloy steel and tool steel is poured in the mold 120 via the ladle 16 and the tundish 180. The molten steel poured in the mold 120 is subjected to first cooling in the mold 120, thus forming a shell on the surface of the molten steel. As the winch 56 is rotated in the reverse direction to vertically move down the lift table 50 at a given casting speed, the casting 220 whose bottom end is supported by the dummy head 48 is pulled out from the bottom portion of the mold 120.

The casting 220 immediately after being pulled out from the mold 120 is held by the guide rolls 44, 44 from both sides in the widthwise direction, as shown in FIG. 7, thus preventing the occurrence of bulging. As cooling water is sprayed on the casting 220 from the nozzles 46, 46 the secondary cooling of the casting 220 is carried out.

During pouring of molten steel in the mold 120, the lid member 240 placed on the power receiving plate 420 is heated at the standby position by the heating unit 320 with an inert gas supplied to the heating chamber 240*a* so that the lid member 240 is preheated to a temperature near the target temperature. After pouring in the mold 120 is completed, with the ladle 16 retreated, the tundish 180 moves upward and the carriage 200 moves. As the tundish 180 moves to the retracting position from the casting position, the lid member 240 lifted up at the standby position moves to the heating position (see FIG. 10A). After pouring in the mold 120 is completed, the lift table 50 moves upward to push the upper end portion of the casting 220 having a shell formed on the surface by a predetermined length from the upper end of the mold 120.

Figure 10B:
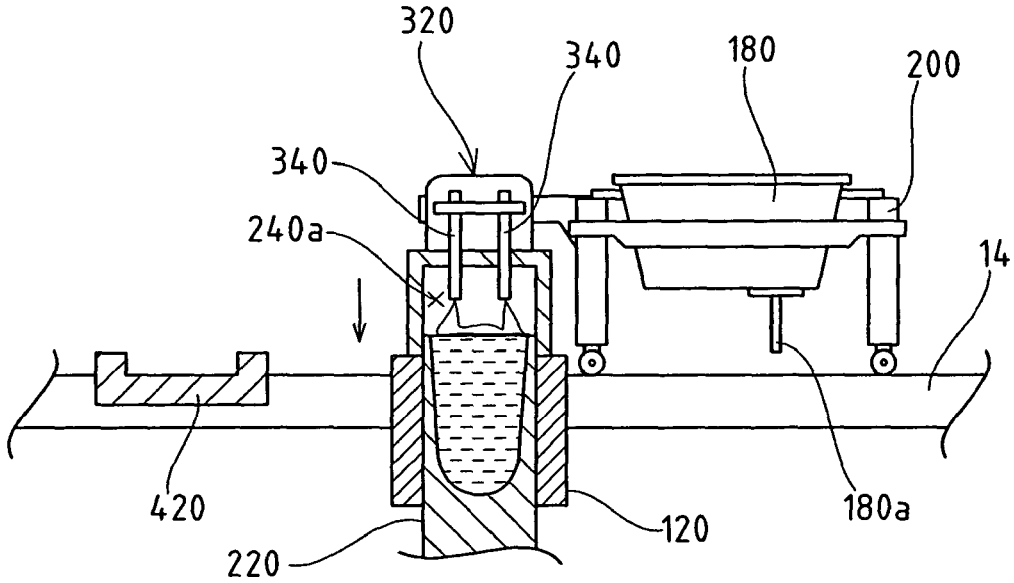

Next, with an inert gas supplied to the heating chamber 240*a*, the lid member 240 moves downward to cover the top portion of the mold 120 and the molten steel in the mold 120 is heated by the heating unit 320 in such a way as to compensate for the heat released from the surface of the molten steel, as shown in FIG. 10B. This prevents the surface of the molten steel in the mold 120 from being coagulated, thus suppressing the production of a shrinkage porosity or a casting head cavity. Further, as heating is applied from the surface of the molten steel to generate large temperature gradation in the up and down direction of the uncoagulated portion, the angle θ of the coagulation front side which will be discussed later is increased. This can suitably suppress the occurrence of internal defects, such as the center porosity, casting head cavity and center segregation or V-shaped segregation. Because the top portion of the mold 120 is covered with the lid member 240 in an approximately sealed manner in this case, efficient heating of the molten steel by the heating unit 320 is accomplished. What is more, because of the lid member 240 preheated, it is possible to suppress a drop in temperature of the surface of the molten steel between the point at which the mold 120 is covered with the lid member 240 and the point at which heating is started. According to the second embodiment, the tundish 180 and the lid member 240 and the heating unit 320 are laid on the common carriage 200, making it possible to shorten the time required to cover the top portion of the casting with the lid member 240 after pouring is completed. It is also possible to reduce a drop in temperature of the surface of the molten steel during that time.

The temperature control unit 400 performs feedback control in such a way as to adjust the gap between the electrodes 340 and the surface of the molten steel in the heating unit 320 based on the temperature of the heating chamber 240*a* detected by the temperature sensor 380 and keep the temperature of the heating chamber 240*a* at the target temperature. Accordingly, a drop in temperature of the surface of the molten steel in the mold 120 is kept at or higher than the solidus casting temperature until coagulation of the casting 220 comes near completion, thereby adequately preventing the coagulation of the surface of the molten steel. After a preset time passes, the heating power of the heating unit 320 is gradually reduced and heating is terminated.

Figure 11A:
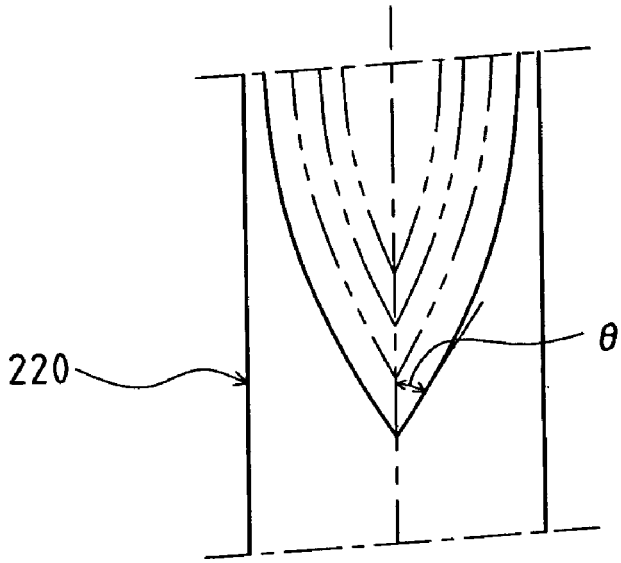
FIG. 11A PRIOR ART
FIG. 11 is an explanatory diagram showing coagulation front side angles of castings according to the prior art and the present invention (second embodiment)
Figure 11B:
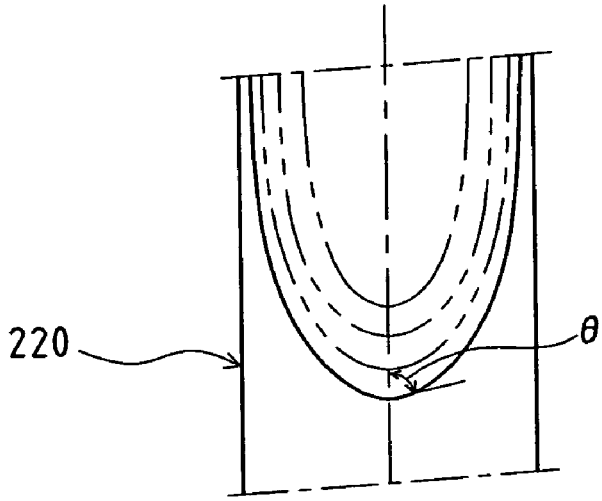

As mentioned earlier, it seems that the occurrence of internal defects, such as the center porosity and center segregation or V-shaped segregation, is influenced by the angle of the coagulation front side of molten steel inside the casting. That is, conventionally, the angle of the coagulation front side (the angle with respect to the center line of the coagulation interface) θ of the molten steel inside the casting 220 would become small, as shown in FIG. 11A, which would encourage the suction of the molten steel whose C, S, P or the like has become denser, causing multiple internal defects. According to the second embodiment, by way of contrast, the upper width becomes wider in the vicinity of the coagulation interface, making the angle θ larger, as shown in FIG. 11B. This reduces the suction of the molten steel whose C, S, P or the like has become denser, thus making it possible to adequately suppress the occurrence of the internal defects. The coagulation front side angle θ can be determined by observing the macro organization of the casting 220.

In other words, even for steel types, such as special steels including high-alloy steel and tool steel, that require severe demands on the product quality, the vertical casting method according to the invention can provide castings which have excellent quality with fewer internal defects, such as the center porosity, casting head cavity and center segregation or V-shaped segregation, inside. In case of casting the casting 220 whose top portion has cross-sectional sizes of 500 mm or greater in thickness and 500 mm or greater in width, the vertical casting method and apparatus according to the second embodiment are particularly effective.

Although the description of the second embodiment has been given of the case where the lid member and the heating unit are provided on the carriage of the tundish, the lid member and the heating unit may be provided on another carriage or moving means or the like so that when the tundish 18 moves to the retracting position from the casting position, the lid member is moved to the heating position quickly.

EXAMPLE 2

Figure 12:
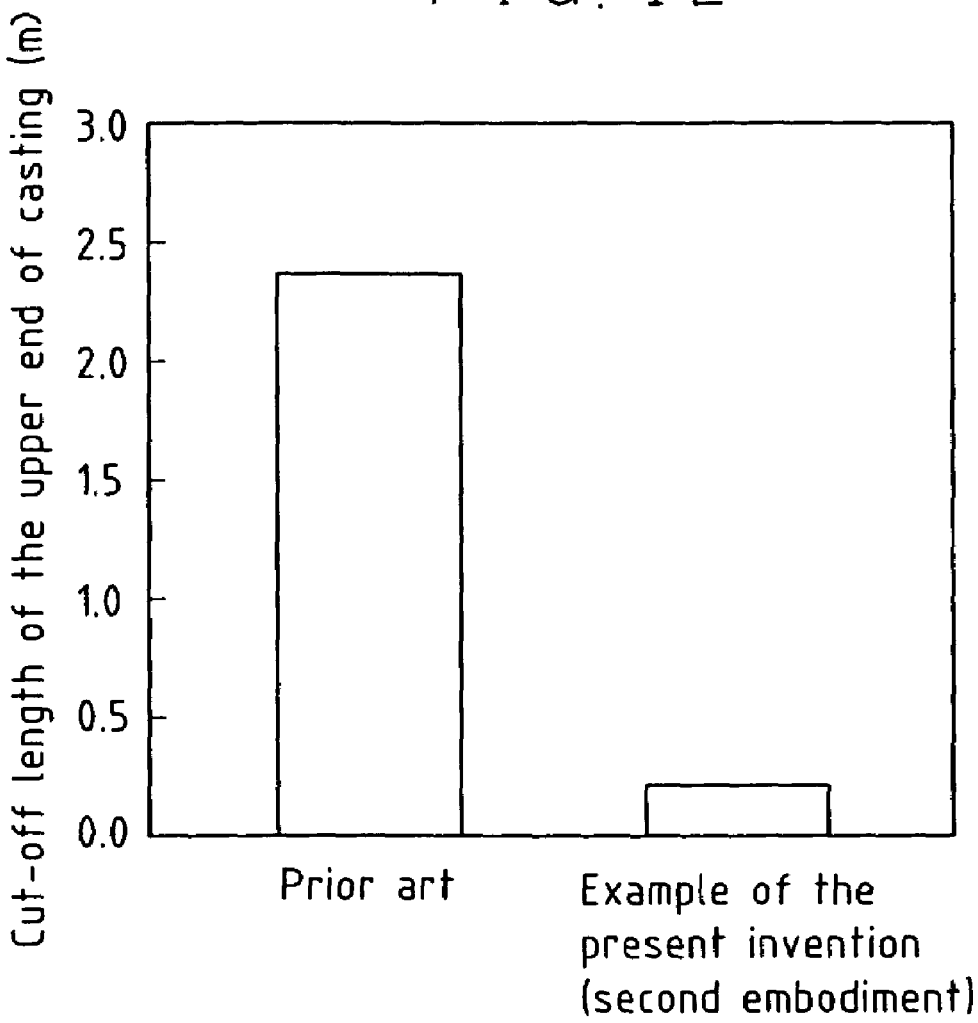
FIG. 12 is a graph showing the results of measuring the cut-off length of an upper end of a casting.
Figure 13:
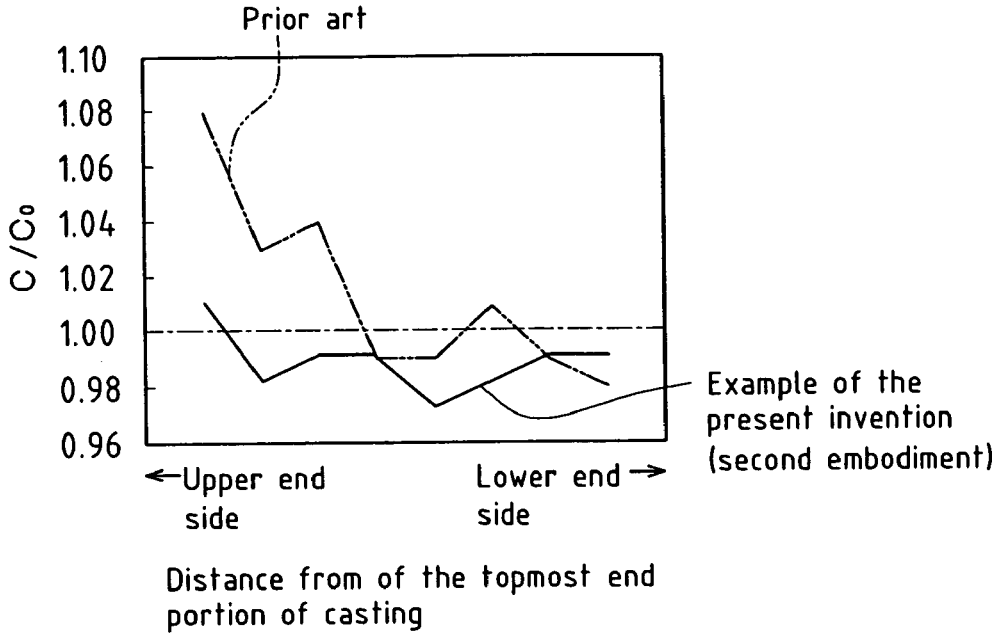
FIG. 13 is a graph showing the results of measuring the segregation of C.
Figure 14:
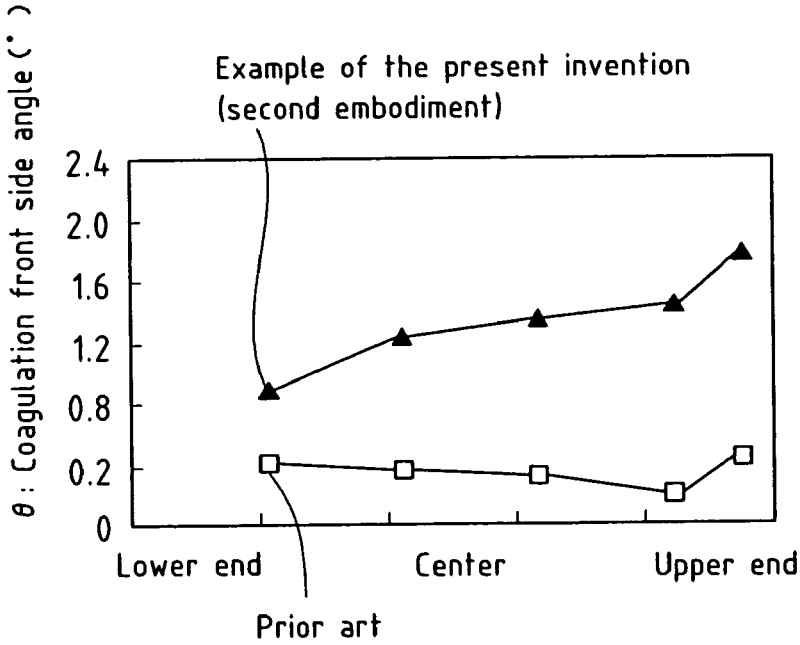
FIG. 14 is a graph showing the results of measuring the coagulation front side angle.

In case of casting a casting which has a thickness of 650 mm and a width of 850 mm using a tool steel as a material, the results of measuring the cut-off length of the upper end of a casting for a case where molten steel is not heated at the time of still standing coagulation after pouring is completed (prior art) and a case where molten steel is heated (Example 2 of the second embodiment) are shown in FIG. 12, and the results of measuring the segregation of C (carbon) are shown in FIG. 13. FIG. 14 shows the coagulation front side angle θ.

As apparent from FIG. 12, according to the prior art that does not perform heating, multiple internal defects, such as the casting head cavity, center segregation or V-shaped segregation, occur, which necessitates discarding of multiple castings, thus lowering the yield. According to Example 2 (second embodiment) that performs heating, as seen from the diagram, the occurrence of the internal defects at the upper end portion of a casting is suppressed, thus significantly reducing the cut-off length of the upper end of a casting.

As apparent from FIG. 13, heating can restrain the segregation of C as compared with the prior art. As apparent from FIG. 14, heating increases the coagulation front side angle θ. That is, it is seen that widening the coagulation front side angle θ can preferably suppress the occurrence of internal defects, such as the center porosity, casting head cavity and center segregation or V-shaped segregation.

As explained above, because at least one pair of opposing sides of each casting according to the present invention are tapered, even those castings which are cast from steel types, such as special steels including high-alloy steel and tool steel, that require severe demands on the product quality, have fewer internal defects, such as the center porosity and center segregation or V-shaped segregation, and have a high quality and improved yield.

In addition, ultra-slow casting at the casting speed set to 0.2 m/min or slower can further suppress the occurrence of internal defects, such as the center porosity and center segregation or V-shaped segregation.

Even for steel types, such as special steels including high-alloy steel and tool steel, that require severe demands on the product quality, the vertical casting method and apparatus according to another embodiment of the present invention can provide castings which have an excellent quality with fewer internal defects, such as the center porosity, casting head cavity and center segregation or V-shaped segregation, by heating molten steel in the mold whose top portion is covered with the lid member at the time of still standing coagulation after pouring of the molten steel is completed. This results in an improved yield. Further, preheating the lid member can suppress a drop in temperature of the surface of the molten steel until heating is started.

What is claimed is:

1. A vertical casting apparatus for casting a casting of a predetermined length by pouring a molten special steel including a high-alloy steel and tool steel in a mold open to the top and bottom thereof, supporting a lower end of the casting having a shell formed on a surface thereof and pulling out said lower end of said casting from a bottom portion of said mold with a lift table, provided below said mold and movable up and down vertically by lifting means, comprising:

a lid member capable of covering a top portion of said mold and set an internally defined heating chamber in an atmosphere of an inert gas;

heating means for heating said molten steel in said mold covered by said lid member with a plasma or arc;

a carriage movable along rails on a casting bed; and a tundish provided on and movable with said carriage; wherein said lid member is provided on and movable with said carriage; and when said tundish comes to a casting position, said lid member comes to a standby position that is set away from said mold, and when said tundish comes to a casting retracting position, said lid member comes to a heating position which said lid member covers a top portion of said mold.

* * * * *